US009194664B1

(12) United States Patent
Smith

(10) Patent No.: US 9,194,664 B1
(45) Date of Patent: Nov. 24, 2015

(54) MAIN GUN SHIELD FOR BATTLE TANK

(71) Applicant: Lucas B. Smith, Moreau, NY (US)

(72) Inventor: Lucas B. Smith, Moreau, NY (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 14/625,784

(22) Filed: Feb. 19, 2015

(51) Int. Cl.
*F41H 5/20* (2006.01)
*F41A 27/08* (2006.01)
*F41A 23/24* (2006.01)

(52) U.S. Cl.
CPC *F41H 5/20* (2013.01); *F41A 23/24* (2013.01); *F41A 27/08* (2013.01)

(58) Field of Classification Search
CPC ..... F41H 5/20; F41H 7/00; F41H 7/02; F41A 23/24; F41A 27/08
USPC ..... 89/36.14, 36.13, 36.16, 36.03, 36.08
See application file for complete search history.

(56) References Cited

U.S. PATENT DOCUMENTS

| | | | | | |
|---|---|---|---|---|---|
| 2,066,326 | A | * | 1/1937 | Brett et al. | 89/37.12 |
| 2,397,809 | A | * | 4/1946 | Roeder et al. | 89/36.13 |
| 2,490,928 | A | * | 12/1949 | Stacey | 89/36.14 |
| 3,138,992 | A | * | 6/1964 | Lewis | 89/36.08 |
| 3,581,621 | A | * | 6/1971 | Bauer | 89/36.14 |
| 3,866,514 | A | * | 2/1975 | Uhl et al. | 89/36.13 |
| 4,142,799 | A | * | 3/1979 | Barton | 356/153 |
| 4,324,169 | A | * | 4/1982 | Ruttgerodt | 89/36.14 |
| 4,438,677 | A | * | 3/1984 | Spotzl et al. | 89/36.13 |
| 4,448,107 | A | * | 5/1984 | Kotai et al. | 89/36.13 |
| 4,481,862 | A | * | 11/1984 | Wiethoff et al. | 89/46 |
| 4,531,447 | A | * | 7/1985 | Bartels | 89/37.07 |
| 4,565,412 | A | * | 1/1986 | Comminge et al. | 305/53 |
| 4,574,683 | A | * | 3/1986 | LeBlanc | 89/33.04 |
| 4,601,230 | A | * | 7/1986 | LeBlanc | 89/1.2 |
| 4,885,977 | A | * | 12/1989 | Kirson et al. | 89/41.05 |
| 4,928,574 | A | * | 5/1990 | Golden | 89/34 |
| 5,048,392 | A | * | 9/1991 | Ruttgerodt et al. | 89/41.02 |
| 5,105,715 | A | * | 4/1992 | Nordmann et al. | 89/36.13 |
| 5,105,716 | A | * | 4/1992 | Hahn et al. | 89/36.13 |
| 5,187,317 | A | * | 2/1993 | Pellarin et al. | 89/36.14 |
| 5,198,608 | A | * | 3/1993 | Cahill et al. | 89/1.13 |
| 5,864,085 | A | * | 1/1999 | Begneu et al. | 89/37.07 |
| 7,021,189 | B2 | * | 4/2006 | Patry et al. | 89/45 |
| 2003/0051599 | A1 | * | 3/2003 | Lundqvist et al. | 89/37.03 |
| 2004/0134339 | A1 | * | 7/2004 | Urvoy | 89/37.07 |
| 2004/0159229 | A1 | * | 8/2004 | Urvoy | 89/41.01 |
| 2004/0200348 | A1 | * | 10/2004 | Urvoy | 89/37.12 |
| 2005/0158694 | A1 | * | 7/2005 | Isoz et al. | 434/16 |
| 2006/0162540 | A1 | * | 7/2006 | Meintjes | 89/37.07 |
| 2010/0035216 | A1 | * | 2/2010 | Trotsky et al. | 434/11 |

* cited by examiner

*Primary Examiner* — Joshua Freeman
(74) *Attorney, Agent, or Firm* — Michael C. Sachs

(57) ABSTRACT

A shield for mounting a 120 mm gun to a tank turret includes a casting with a through hole configured to receive the 120 mm gun. A mounting flange is disposed in the through hole for fixing the 120 mm gun to the casting. A pair of trunnions are defined by a combination of the casting and a pair of respective trunnion caps. A shroud is removably fixed to the casting and includes a pair of bosses that interlock with a pair of protrusions in an interior of the casting.

15 Claims, 7 Drawing Sheets

B
28

20
28
7
B
36
24
A
38
26
7

36
38

MAIN GUN SHIELD FOR BATTLE TANK

STATEMENT OF GOVERNMENT INTEREST

The inventions described herein may be manufactured, used and licensed by or for the United States Government.

BACKGROUND OF THE INVENTION

The invention relates in general to military tanks and in particular to apparatus and methods for upgrading the main gun on a military tank.

The U.S. M60 series main battle tank includes a 105 mm main gun with a rifled barrel. There is a desire to upgrade the main gun on the M60 to a 120 mm gun with a smooth bore barrel. The main gun upgrade improves the lethality of the M60 series tanks. The 120 mm gun, such as the M256 120 mm smooth bore gun, will not fit in the existing shield casting for the M68 105 mm gun.

One method of upgrading the M60 to a 120 mm gun is to completely replace the turret with an M1A1 Abrams turret. This method involves a complete replacement of every component of the tank above the hull of the main battle tank. The new components include the M256 120 mm smooth bore gun, fire control, thermal sights, ammunition storage and suspension.

Another method of upgrading the M60 to a 120 mm gun includes installing an Israeli Military Industries (IMI) 120 mm smooth bore gun into an up-armored, existing M60 turret, as well as upgrading the engine, armor and chassis of the tank.

A third method includes modifying the existing M60A3 shield casting, which is the interface between the gun system and the turret. This method includes boring out the shield casting to accept the larger 120 mm M256 gun.

The known methods of upgrading the M60 to a 120 mm gun require extensive changes and expense. A need exists for a less complicated and less expensive apparatus and method for upgrading the M60 tank to a 120 mm gun.

SUMMARY OF INVENTION

One aspect of the invention is a shield for mounting a main gun to a tank turret. The shield has a central longitudinal axis. The shield includes a casting with a through hole to receive the main gun. A mounting flange is disposed in the through hole for fixing the gun to the casting. A pair of trunnions are defined by a combination of the casting and a pair of respective trunnion caps. The trunnions have an axis that is transverse to the central longitudinal axis.

A front surface of the casting includes a convex portion and a planar portion. A gunner's sight through bore is formed in the casting and has a longitudinal axis parallel to the central longitudinal axis. A small caliber weapon through bore is formed in the casting and has a longitudinal axis parallel to the central longitudinal axis.

A shroud is fixed to the casting and has a through hole configured to receive the gun. The shroud has a pair of bosses that interlock with a pair of protrusions in an interior of the casting.

The shield may include a first tube inserted in the gunner's sight through bore and a second tube inserted in the small caliber weapon through bore.

The pair of protrusions in the interior of the casting may fit in respective slots formed forward of the pair of bosses on the shroud. The shroud may be rotated with respect to the casting to interlock the bosses and protrusions. The shroud may cover the mounting flange in the casting. The perimeter of the shroud may have a contour that matches a contour of a perimeter of the through hole in the front surface of the casting.

Lightening holes may be formed in the casting.

Another aspect of the invention is a method that includes providing a monolithic casting with a through hole configured to receive a gun. The casting includes a flange disposed in the through hole for fixing the gun to the casting and a pair of protrusions formed in an interior of the casting.

The method includes providing a shroud having a through hole configured to receive the gun and having a pair of bosses. The shroud is fixed to the casting by rotating the shroud inside the casting so that the pair of bosses interlock with the pair of protrusions in the interior of the casting.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION

Figure 1:
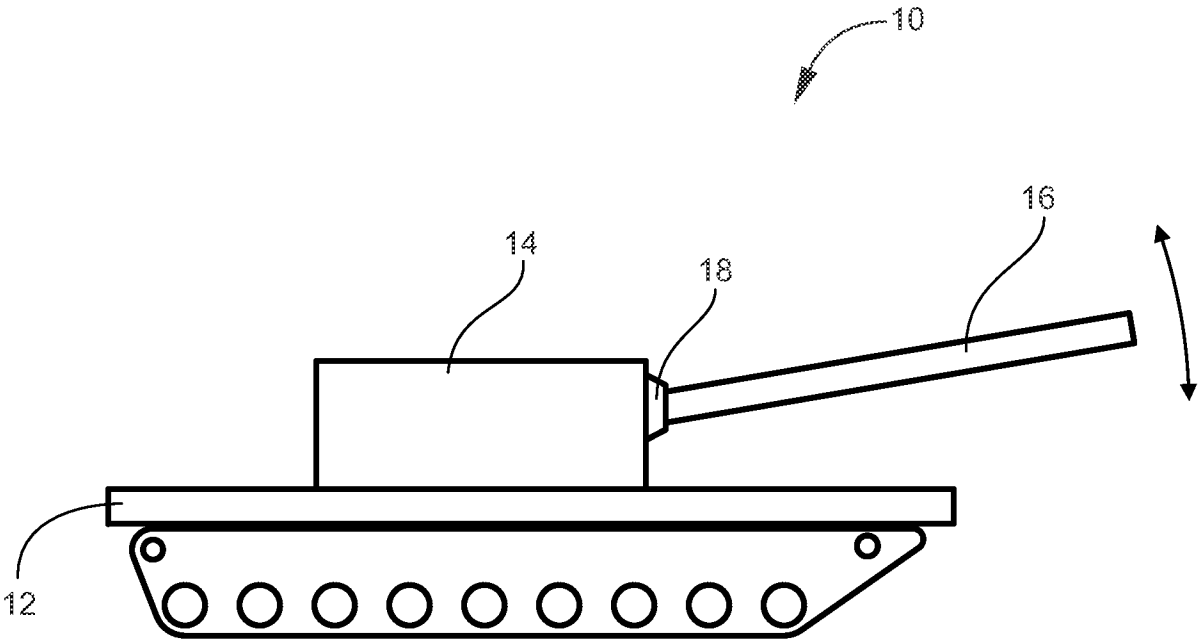
FIG. 1 is a schematic of a tank.
Figure 2:
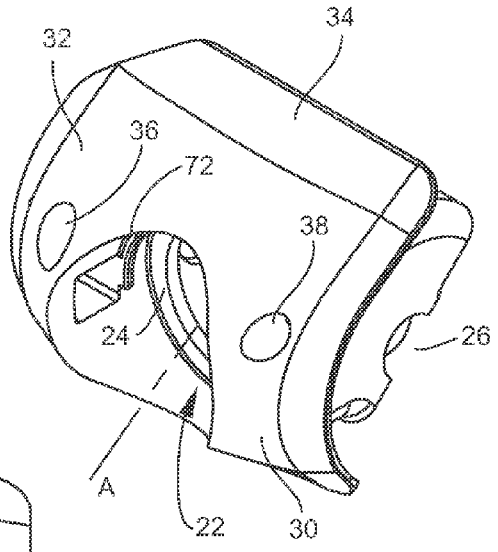
FIG. 2 is a perspective view of a shield casting.
Figure 3:
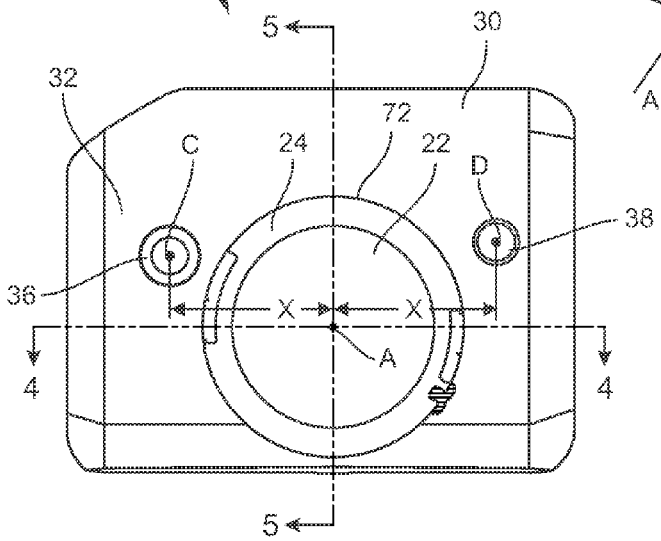
FIG. 3 is a front elevation view of the casting of FIG. 2, partially sectioned along the line 3-3 of FIG. 4.
Figure 4:
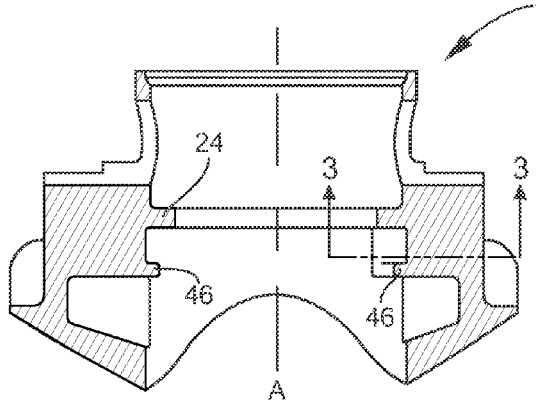
FIG. 4 is a sectional view along the line 4-4 of FIG. 3.
Figure 5:
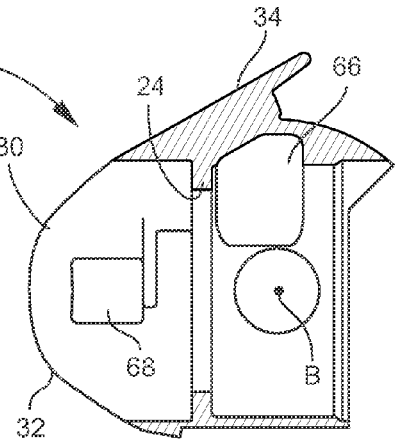
FIG. 5 is a sectional view along the line 5-5 of FIG. 3.
Figures 6, 7, 8, 9:
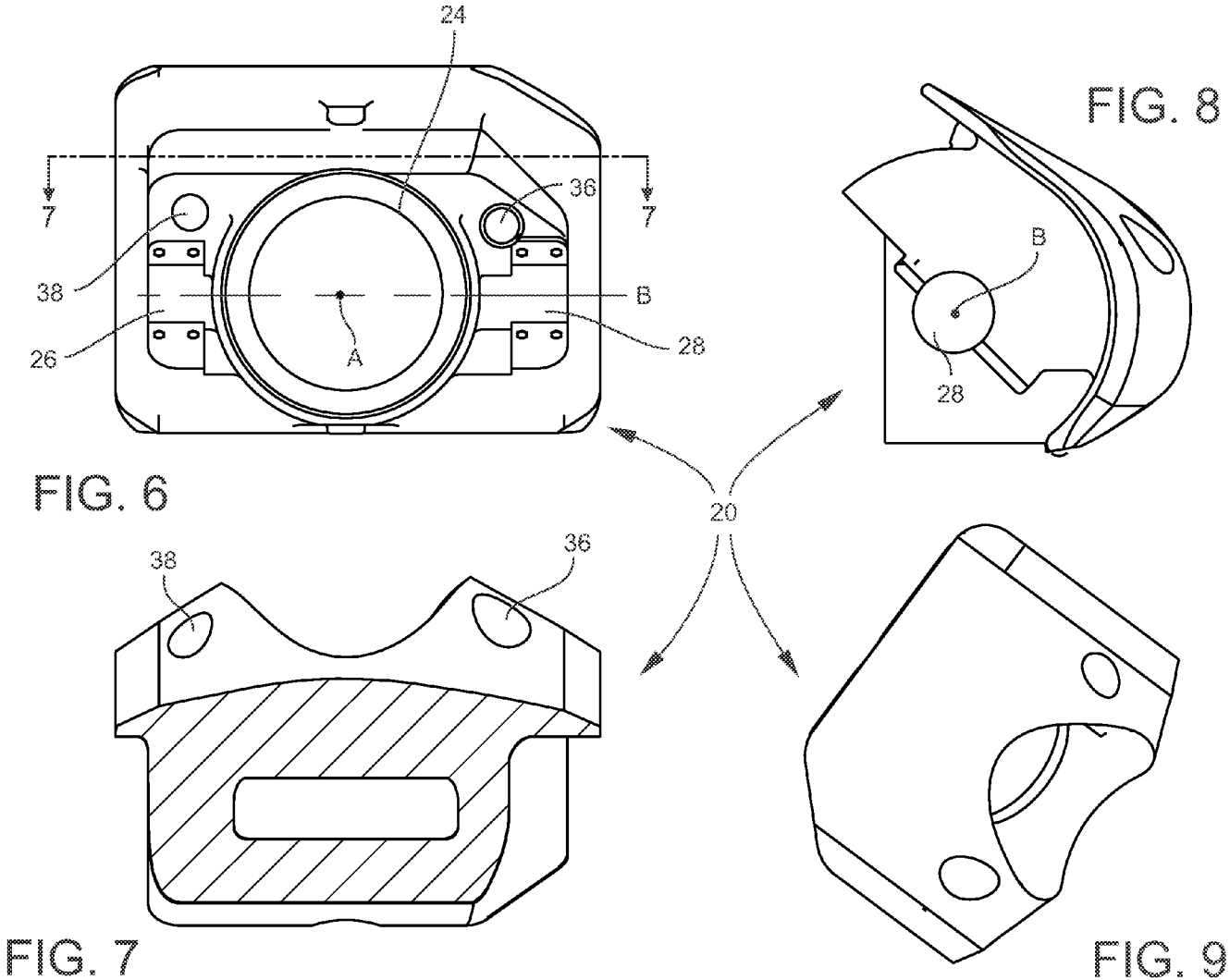
FIG. 6 is a rear elevation view of the casting of FIG. 2.
FIG. 7 is a sectional view along the line 7-7 of FIG. 6.
FIG. 8 is a side view of FIG. 6.
FIG. 9 is a top perspective view of the casting of FIG. 2.

FIG. 1 is a schematic of a tank 10 having a hull 12 and a turret 14 rotatably fixed to hull 12. A main gun 16, such as a 120 mm gun, is rotatably fixed to turret 14. Turret 14 rotates horizontally about a vertical axis to vary the azimuth of gun 16. The elevation angle of gun 16 is varied by rotating the gun up and down with respect to turret 14, as shown by the arrows in FIG. 1. The interface 18 between the gun 16 and the turret 14 includes a means to mount the gun 16 to the turret 14 and to vary the elevation angle of the gun 16 with respect to the turret 14. The interface 18 is known as a rotor or shield. The term "shield" will be used herein to refer to the interface 18.

A novel shield for upgrading an M60 tank with a 120 mm gun uses the existing shield interfaces on the M60 tank. The novel shield includes a monolithic casting made of armor steel. The casting has features that may be formed by casting or by machining or a combination of both. A second, smaller casting functions as a shroud for the shield. The shroud protects portions of the shield. The shield is the main interface between the tank turret 14 and the main gun 16. The shield includes interfaces for the gunner's sight, the coaxial weapon, the resolver, and the fire control system. The shield and shroud mimic the exterior shape of an M60 tank having a 105 mm gun, to thereby maintain the tank's visual signature.

Figure 10:
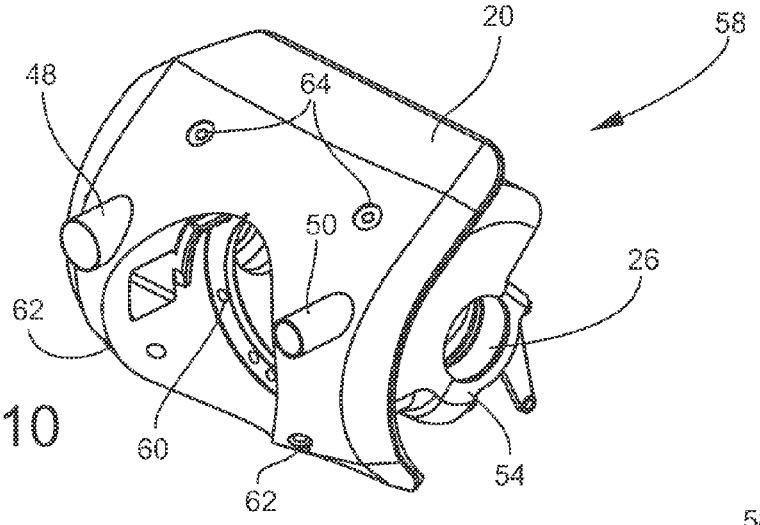
FIG. 10 is a perspective view of a shield assembly.
Figure 15:
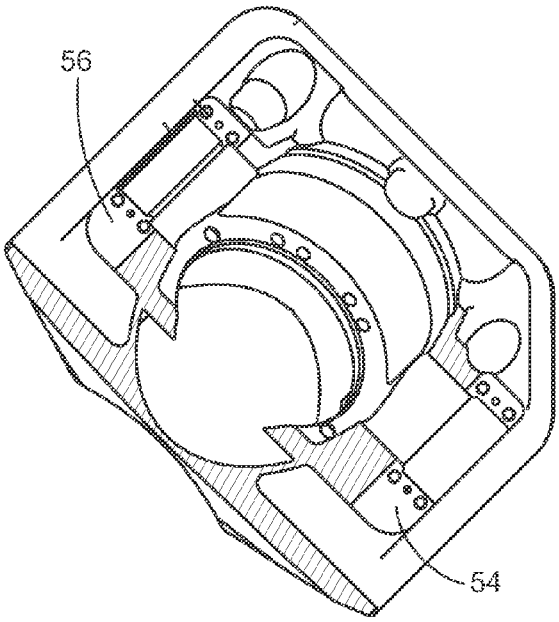
FIG. 15 is a sectional view along the line 15-15 of FIG. 13.
Figure 16:
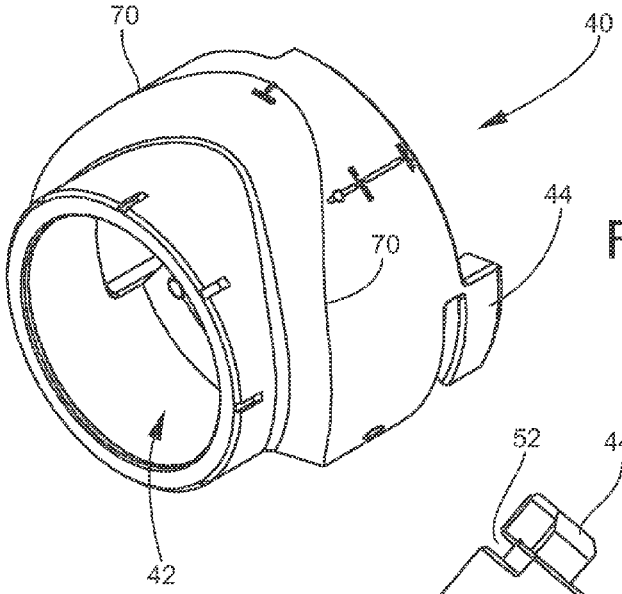
FIG. 16 is a front perspective view of a shroud.
Figure 17:
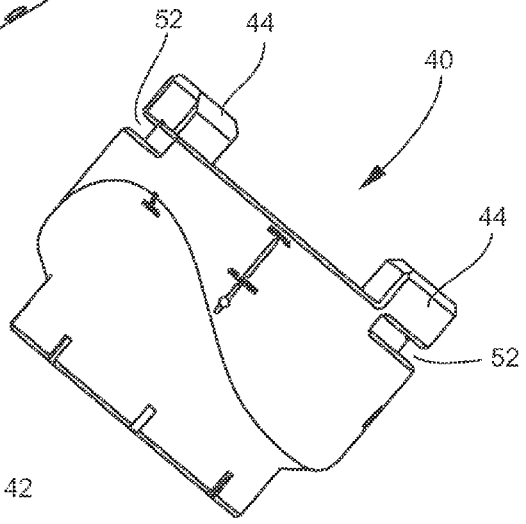
FIG. 17 is a top view of the shroud of FIG. 16.
Figure 18:
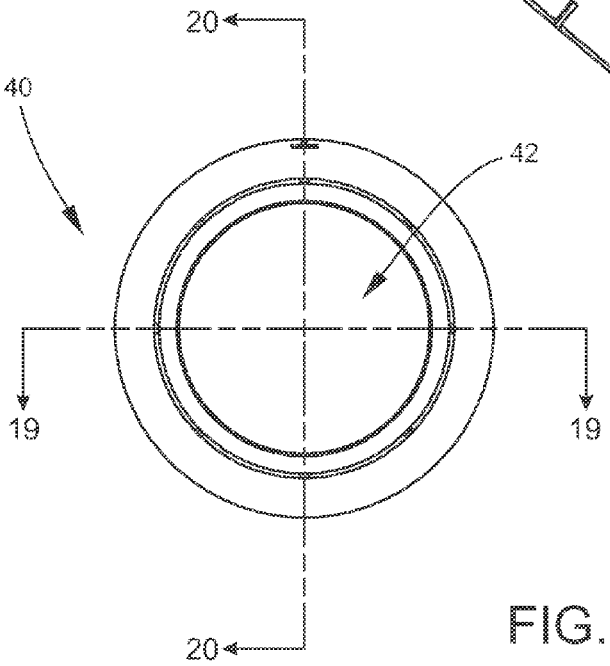
FIG. 18 is a front elevation view of the shroud of FIG. 16.
Figure 19:
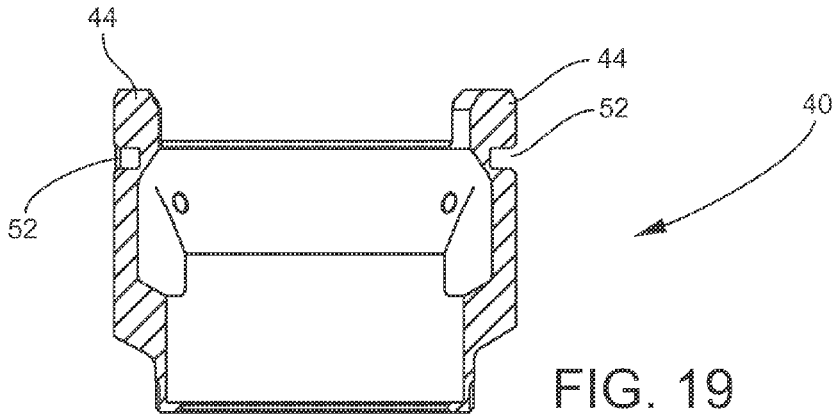
FIG. 19 is a sectional view along the line 19-19 of FIG. 18.
Figure 20:
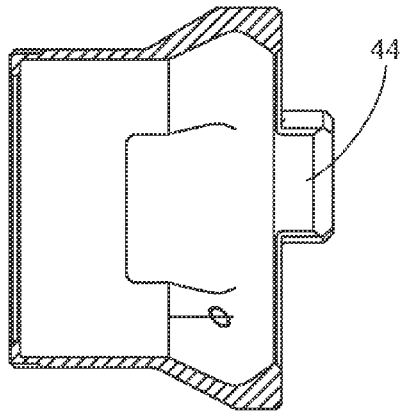
FIG. 20 is a sectional view along the line 20-20 of FIG. 18.
Figure 21:
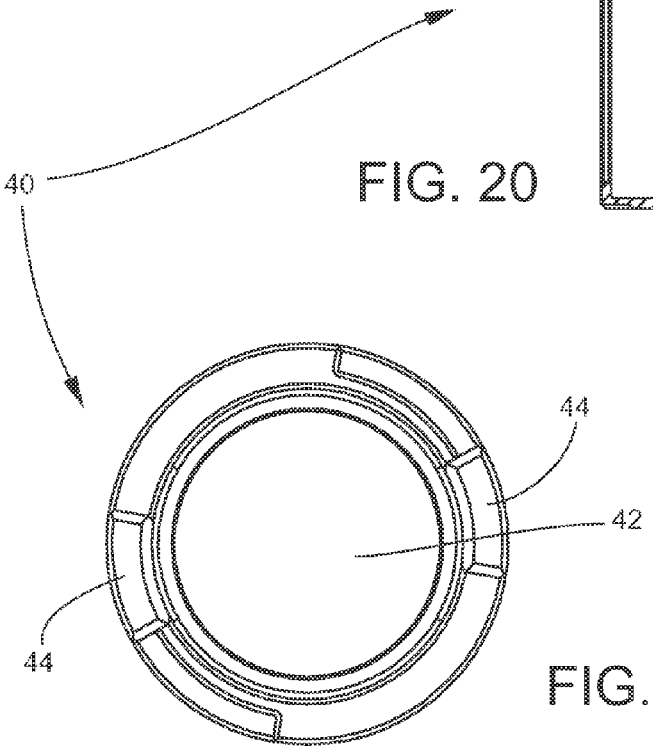
FIG. 21 is a rear view of FIG. 18.

As shown in FIGS. 2-9, the novel shield includes a shield casting 20 having a through hole 22 configured to receive the 120 mm gun 16. The shield casting 20 has a central longitudinal axis A. A mounting flange 24 is disposed in the through hole 22 for fixing the cradle (not shown) of the 120 mm gun 16 to the casting 20. A pair of trunnions 26, 28 are defined by a combination of the casting 20 and a pair of respective trunnion caps 54, 56 (FIGS. 10 and 15). The trunnions 26, 28 have an axis B (FIG. 5) that is transverse to the central longitudinal axis A. The trunnions 26, 28 receive the trunnion pins (not shown) that are fixed to the turret 14. The elevation of the gun 16 is be adjusted by rotating the gun 16 about axis B.

A front surface 30 of the casting 20 includes a convex portion 32 and a planar portion 34. A gunner's sight through bore 36 is formed in the casting 20 and has a longitudinal axis C parallel to the central longitudinal axis A. A small caliber weapon through bore 38 is formed in the casting 20 and has a longitudinal axis D parallel to the central longitudinal axis A. The small caliber weapon may be, for example, a 7.62 mm or .50 caliber weapon. The horizontal offset of axis C of bore 36 from axis A is preferably the same distance X (FIG. 3) as the horizontal offset of axis D of bore 38 from axis A.

Lightening holes 66, 68 (FIG. 5) are formed in casting 20 to reduce its weight.

FIGS. 10-15 show the shield assembly 58. The trunnion caps 54, 56 are fixed to casting 20 using, for example, threaded fasteners. A first tube 48 is inserted in the gunner's sight through bore 36 and a second tube 50 is inserted in the small caliber weapon through bore 38. Mounting flange 24 has holes 60 formed therein for receiving fasteners that fix the cradle of gun 16 to flange 24. Shield assembly 58 may include threaded holes 64 for receiving lifting eyes.

Figure 11:
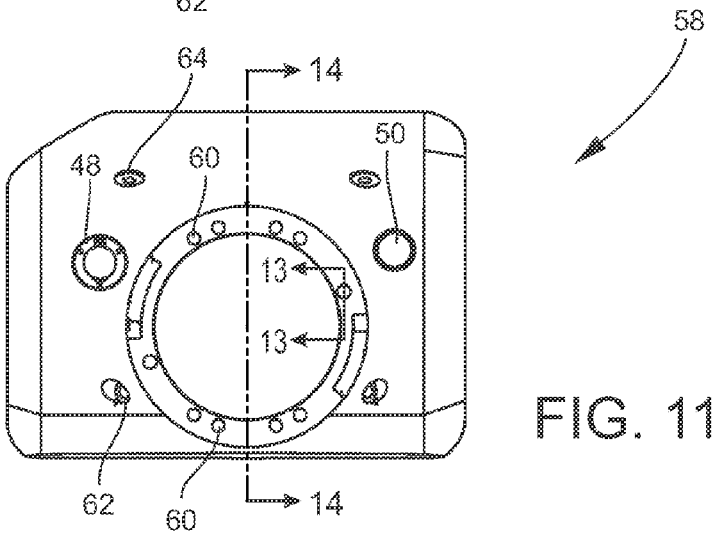
FIG. 11 is an elevation view of FIG. 10.
Figure 12:
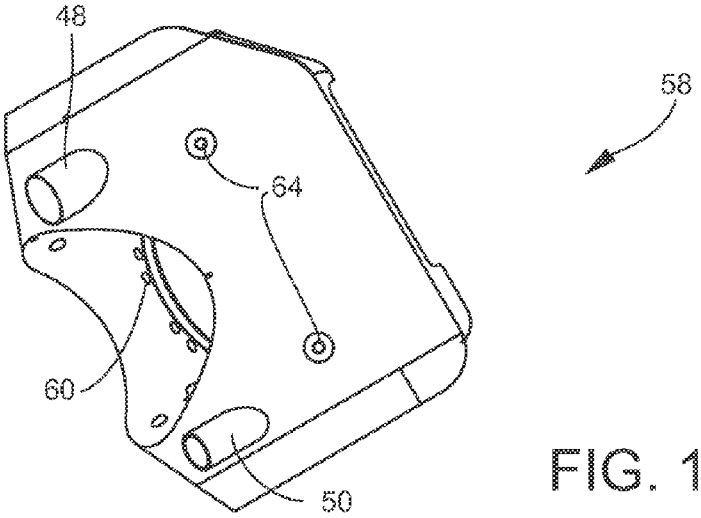
FIG. 12 is another perspective view of the assembly of FIG. 10.
Figure 13:
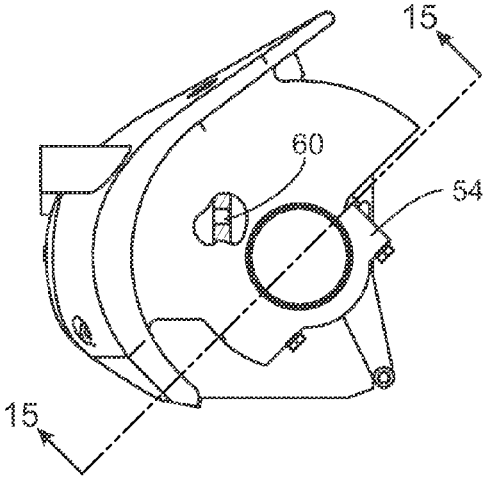
FIG. 13 is a side view of FIG. 11, partially sectioned along the line 13-13 of FIG. 11.
Figure 14:
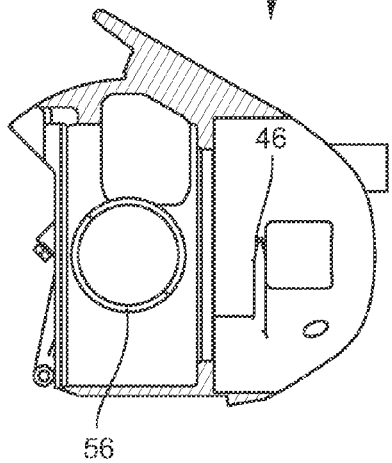
FIG. 14 is a sectional view along the line 14-14 of FIG. 11.

A shroud 40 (FIGS. 16-21) is removably fixed to the casting 20 and has a through hole 42 configured to receive the 120 mm gun 16. The shroud 40 includes a pair of bosses 44, 44 that interlock with a pair of protrusions 46, 46 (FIG. 14) in an interior of the casting 20. The pair of protrusions 46, 46 fit in respective slots 52, 52 formed forward of the pair of bosses 44, 44. After gun 16 is inserted and fixed to shield casting 20, shroud 40 fits over gun 16 and is inserted in hole 22 in the front surface 30 of casting 20. Shroud 40 is then rotated a quarter turn inside casting 20 so that protrusions 46, 46 in casting 20 lock into slots 52, 52 forward of bosses 44, 44 on shroud 40. Shroud 40 is then fastened to casting 20 using, for example, threaded fasteners fixed in holes 62 (FIG. 11).

The contour of the perimeter 70 of the shroud 40 is configured to mate with or complement the contour of the perimeter 72 of the opening in the front surface 30 of casting 20. The mating surfaces 70, 72 create the appearance of a continuous surface. Shroud 40 protects mounting flange 24 from, for example, hostile fire. Shroud 40 is easily removable for access to the interior of casting 20. Shroud 40 is much simpler to install and remove than prior art devices, which often included many separate pieces bolted to the turret.

Compared to prior art shields, the inventive shield assembly 58 and shroud 40 have fewer parts, fewer fasteners, require dramatically less welding to install and weigh less. The assembly 58 and shroud 40 maintain the shape of the turret interface area of a tank having a 105 mm gun, thereby keeping the tank appearance and signature similar. The shroud 40 matches the contour of the shield assembly 58 to provide sleek and uniform transitions between surfaces.

While the invention has been described with reference to certain embodiments, numerous changes, alterations and modifications to the described embodiments are possible without departing from the spirit and scope of the invention as defined in the appended claims, and equivalents thereof.

What is claimed is:

1. A shield for mounting a 120 mm gun to a tank turret, the shield having a central longitudinal axis and comprising:

a casting with a through hole configured to receive the 120 mm gun and centered on the central longitudinal axis;

a mounting flange disposed in the through hole for fixing the 120 mm gun to the casting;

a pair of trunnions defined by a combination of the casting and a pair of respective trunnion caps, the trunnions having an axis that is transverse to the central longitudinal axis;

a front surface of the casting including a convex portion and a planar portion;

a gunner's sight through bore formed in the casting and having a longitudinal axis parallel to the central longitudinal axis;

a small caliber weapon through bore formed in the casting and having a longitudinal axis parallel to the central longitudinal axis; and a shroud fixed to the casting and having a through hole configured to receive the 120 mm gun, the shroud including a pair of bosses that interlock with a pair of protrusions in an interior of the casting.

2. The shield of claim 1, further comprising a first tube inserted in the gunner's sight through bore and a second tube inserted in the small caliber weapon through bore.

3. The shield of claim 1, wherein the pair of protrusions in the interior of the casting fit in respective slots formed forward of the pair of bosses on the shroud.

4. The shield of claim 3, wherein the shroud is rotated with respect to the casting to interlock the bosses and protrusions.

5. The shield of claim 3, wherein the shroud covers the mounting flange in the casting.

6. The shield of claim 3, wherein a perimeter of the shroud has a contour that matches a contour of a perimeter of the through hole in the front surface of the casting.

7. The shield of claim 6, further comprising lightening holes in the casting.

8. A shield for mounting a 120 mm gun to a tank turret, comprising:

a monolithic casting with a through hole configured to receive the 120 mm gun and centered on a central longitudinal axis;

a flange disposed in the through hole and centered on the central longitudinal axis, for fixing the 120 mm gun to the casting;

a pair of trunnions defined by a combination of the casting and a pair of respective trunnion caps fixed to the casting, the trunnions having an axis that is transverse to the central longitudinal axis of the casting;

a front surface of the casting including a convex portion and a planar portion;

a gunner's sight through bore formed in the casting and having a longitudinal axis parallel to the central longitudinal axis with a first tube inserted in the gunner's sight through bore;

a small caliber weapon through bore formed in the casting and having a longitudinal axis parallel to the central longitudinal axis with a second tube inserted in the small caliber weapon through bore; and a shroud fixed to the casting and having a through hole configured to receive the 120 mm gun, the shroud including a pair of bosses that interlock with a pair of protrusions in an interior of the casting.

9. The shield of claim 8, wherein the pair of protrusions in the interior of the casting fit in respective slots formed forward of the pair of bosses on the shroud.

10. The shield of claim 9, wherein the shroud is rotated with respect to the casting to interlock the bosses and protrusions.

11. The shield of claim 10, wherein the shroud covers the mounting flange in the casting.

12. The shield of claim 11, wherein a perimeter of the shroud has a contour that matches a contour of a perimeter of the through hole in the front surface of the casting.

13. A method, comprising:

providing a monolithic casting with a through hole configured to receive a 120 mm gun, the casting including a flange disposed in the through hole for fixing the 120 mm gun to the casting and a pair of protrusions formed in an interior of the casting;

providing a shroud having a through hole configured to receive the 120 mm gun and a pair of bosses; and fixing the shroud to the casting by rotating the shroud inside the casting so that the pair of bosses interlock with the pair of protrusions in the interior of the casting.

14. The method of claim 13, wherein fixing the shroud includes fixing the shroud to the casting with threaded fasteners.

15. The method of claim 13, wherein rotating the shroud includes rotating the shroud a quarter turn.

* * * * *